US009291930B2

(12) United States Patent
Yamada et al.

(10) Patent No.: US 9,291,930 B2
(45) **Date of Patent: *Mar. 22, 2016**

(54) TONER FOR DEVELOPING ELECTROSTATIC LATENT IMAGE

(71) Applicant: Konica Minolta, Inc., Chiyoda-ku (JP)

(72) Inventors: Chiaki Yamada, Ibaraki (JP); Masahiro Anno, Sakai (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/073,956

(22) Filed: Nov. 7, 2013

(65) Prior Publication Data

US 2014/0134529 A1 May 15, 2014

(30) Foreign Application Priority Data

Nov. 15, 2012 (JP) ..... 2012-251383

(51) Int. Cl.
*G03G 9/09* (2006.01)

(52) U.S. Cl.
CPC ..... *G03G 9/0904* (2013.01); *G03G 9/091* (2013.01); *G03G 9/0906* (2013.01); *G03G 9/0912* (2013.01); *G03G 9/0914* (2013.01); *G03G 9/0922* (2013.01); *G03G 9/0926* (2013.01)

(58) Field of Classification Search
USPC ..... 430/108.21, 108.23, 108.9
See application file for complete search history.

(56) References Cited

U.S. PATENT DOCUMENTS

| | | | | |
|---|---|---|---|---|
| 4,980,258 | A | 12/1990 | Aoki et al. | |
| 7,553,432 | B2 | 6/2009 | Nakamura | |
| 2003/0118931 | A1 | 6/2003 | Yano et al. | |
| 2007/0020545 | A1 | 1/2007 | Bossidan et al. | |
| 2009/0098476 | A1* | 4/2009 | Denton et al. | 430/108.9 |
| 2009/0098477 | A1 | 4/2009 | Carter, Jr. et al. | |
| 2009/0280425 | A1 | 11/2009 | Denton et al. | |
| 2009/0286176 | A1 | 11/2009 | Ohmura et al. | |
| 2011/0151362 | A1 | 6/2011 | Yasukawa et al. | |
| 2014/0087305 | A1 | 3/2014 | Yamada et al. | |
| 2014/0134528 | A1 | 5/2014 | Yamada et al. | |
| 2014/0134536 | A1 | 5/2014 | Yamada et al. | |
| 2014/0134537 | A1* | 5/2014 | Yamada et al. | 430/114 |

FOREIGN PATENT DOCUMENTS

| | | | |
|---|---|---|---|
| JP | 01-145664 | A | 6/1989 |
| JP | 2-222967 | A | 9/1990 |
| JP | 02-251860 | A | 10/1990 |
| JP | 03-015860 | A | 1/1991 |
| JP | 5-134451 | A | 5/1993 |

(Continued)

OTHER PUBLICATIONS

Translation of JP 2000-019782 published Jan. 2000.*

(Continued)

*Primary Examiner* — Peter Vajda
(74) *Attorney, Agent, or Firm* — Buchanan Ingersoll & Rooney PC

(57) ABSTRACT

Toner for developing an electrostatic latent image contains toner particles, the toner particles contain a resin and a pigment, the pigment includes a first pigment and a second pigment, the first pigment is carbon black, and the second pigment is C. I. Pigment Brown 23 and/or C. I. Pigment Brown 25.

4 Claims, 3 Drawing Sheets

(56) References Cited

FOREIGN PATENT DOCUMENTS

| | | | | | |
|---|---|---|---|---|---|
| JP | 09-269615 | A | | 10/1997 | |
| JP | 10-097105 | A | | 4/1998 | |
| JP | 11-007159 | A | | 1/1999 | |
| JP | 2000-019782 | | * | 1/2000 | ..... G03G 9/097 |
| JP | 2000-019782 | A | | 1/2000 | |
| JP | 2002-220477 | A | | 8/2002 | |
| JP | 2003-005447 | A | | 1/2003 | |
| JP | 2003-015359 | A | | 1/2003 | |
| JP | 2003-207944 | A | | 7/2003 | |
| JP | 2004-271585 | A | | 9/2004 | |
| JP | 2007-528006 | A | | 10/2007 | |
| JP | 2008-003360 | A | | 1/2008 | |
| JP | 2009-133973 | A | | 6/2009 | |
| JP | 2009-301026 | A | | 12/2009 | |
| JP | 2013-15737 | A | | 1/2013 | |
| JP | 2014-66886 | A | | 4/2014 | |
| JP | 2014-98847 | A | | 5/2014 | |
| JP | 2014-98849 | A | | 5/2014 | |
| JP | 2014-99848 | A | | 5/2014 | |
| WO | 2012/105951 | A1 | | 8/2012 | |

OTHER PUBLICATIONS

Technical Data of Pigment Brown 25 from Hangzhou XColor published 2010: http://www.xcolorpigment.com/pigment-brown-25.html.*

Extended European Search Report dated Feb. 21, 2014, issued by the European Patent Office in corresponding European Patent Application No. 13190827.9-1303. (6 pages).

Grant, R., et al., Grant & Hackh's Chemical Dictionary, 5th Edition, McGraw-Hill Book Company, New York (1987), pp. 40-41.

U.S. Office Action dated Sep. 17, 2014 issued in related U.S. Appl. No. 14/073,940 (14 pages).

Office Action (Notice of Grounds of Rejection) issued on Nov. 18, 2014, by the Japanese Patent Office in corresponding Japanese Patent Application No. 2012-251383 and an English translation of the Office Action. (4 pages).

American Chemical Society (ACS) File Registry No. 35869-64-8 on STN, copyright 2014, which was entered in STN on Nov. 16, 1984. (2 pages).

American Chemical Society (ACS) File Registry No. 6992-11-6 on STN, copyright 2014, which was entered in STN on Nov. 16, 1984. (1 page).

American Chemical Society (ACS) File Registry No. No. 11099-03-9 on STN, copyright 2015, which was entered in STN on Nov. 16, 1984. (1 page).

Office Action issued Feb. 5, 2015 in related U.S. Appl. No. 14/073,940 (39 pages).

Office Action (Decision to Grant) issued on Apr. 7, 2015, by the Japanese Patent Office in corresponding Japanese Patent Application No. 2012-251383 and an English translation of the Office Action. (6 pages).

Office Action (Decision to Grant Patent) issued on Apr. 7, 2015, by the Japanese Patent Office in Japanese Patent Application No. 2012-251382 and an English translation of the Office Action. (6 pages).

Final Office Action issued by the U.S. Patent and Trademark Office on Jul. 16, 2015, in U.S. Appl. No. 14/073,940. (41 pages).

* cited by examiner

TONER FOR DEVELOPING ELECTROSTATIC LATENT IMAGE

This application is based on Japanese Patent Application No. 2012-251383 filed with the Japan Patent Office on Nov. 15, 2012, the entire content of which is hereby incorporated by reference.

BACKGROUND OF THE INVENTION

1. Field of the Invention

The present invention relates to toner for developing an electrostatic latent image.

2. Description of the Related Art

For toner for developing an electrostatic latent image used in an image formation apparatus of an electrophotography type, carbon black has widely been used as a pigment (a coloring agent) for obtaining a black image. For example, Japanese Laid-Open Patent Publication No. 2009-301026 discloses use of carbon black together with any cyan pigment of C. I. Pigment Blue 15:1, 15:2, 15:3 for uniformly dispersing a coloring agent.

SUMMARY OF THE INVENTION

Toner for developing an electrostatic latent image used in an image formation apparatus of an electrophotography type includes a dry developer and a liquid developer. Toner particles in the dry developer contain a resin and a pigment as main components, however, a ratio of a pigment contained in the toner particles is normally lower than 10 mass %. This ratio is determined by relation between a particle size of the toner particles and desired image density. This is because an amount of adhesion of toner particles on such a recording material as paper, that is, an image film thickness, is normally approximately equal to a thickness of a toner particle monolayer and hence a particle size of toner particles is reflected on image density.

A liquid developer is characterized by a smaller particle size of toner particles than that of a dry developer, from a point of view of high image quality, safety, and the like. Though toner particles contained in this liquid developer are mainly composed of a resin and a pigment, in order to ensure image density on a recording material, a ratio of a pigment should be increased in accordance with decrease in particle size of toner particles. Therefore, toner particles in a liquid developer normally contain a pigment at a higher ratio than toner particles in a dry developer.

In order to meet demands for high image quality and low cost in recent years, a ratio of a pigment contained in toner particles should be increased and high image density should be realized without increase in an amount of adhesion.

In toner for developing an electrostatic latent image for obtaining a black image, however, when a content of carbon black in toner particles is increased in order to ensure sufficient image density, disadvantageously, electrical resistance of the toner particles is lowered and dissatisfactory transfer in formation of an image of an electrophotography type takes place.

As measures against such dissatisfactory transfer, mixing of a cyan pigment as disclosed in Japanese Laid-Open Patent Publication No. 2009-301026 can increase electrical resistance as compared with a case where only carbon black is contained. When a ratio of blend of a pigment is increased in particular, however, even by mixing a cyan pigment, resistance cannot sufficiently be controlled and dissatisfactory transfer may take place. In addition, in controlling electrical resistance only with a cyan pigment, a content of a cyan pigment with respect to the pigment as a whole increases, and hence an appropriate hue may not be obtained.

The present invention was made in view of such circumstances, and an object thereof is to provide toner for developing an electrostatic latent image satisfying image density and a hue and also preventing the problem of dissatisfactory transfer.

The present inventor has conducted dedicated studies in order to solve the problem described above, and has found that it is most effective to use together with carbon black, a pigment capable of retaining a black hue without impairing transfer performance. The present inventor has further conducted studies based on this finding and completed the present invention.

Namely, toner for developing an electrostatic latent image according to the present invention contains toner particles, the toner particles contain a resin and a pigment, the pigment includes a first pigment and a second pigment, the first pigment is carbon black, and the second pigment is C. I. (Color Index) Pigment Brown 23 and/or C. I. Pigment Brown 25.

The pigment may further include a third pigment and/or a fourth pigment, the third pigment is C. I. Pigment Blue 15:3 and/or C. I. Pigment Blue 15:4, and the fourth pigment is at least one type of a yellow pigment selected from the group consisting of C. I. Pigment Yellow 74, C. I. Pigment Yellow 155, C. I. Pigment Yellow 180, and C. I. Pigment Yellow 185.

Preferably, the first pigment is contained by 40 to 60 mass % with respect to a total amount of the pigment, and the second pigment is contained by 25 to 45 mass % with respect to the total amount of the pigment.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
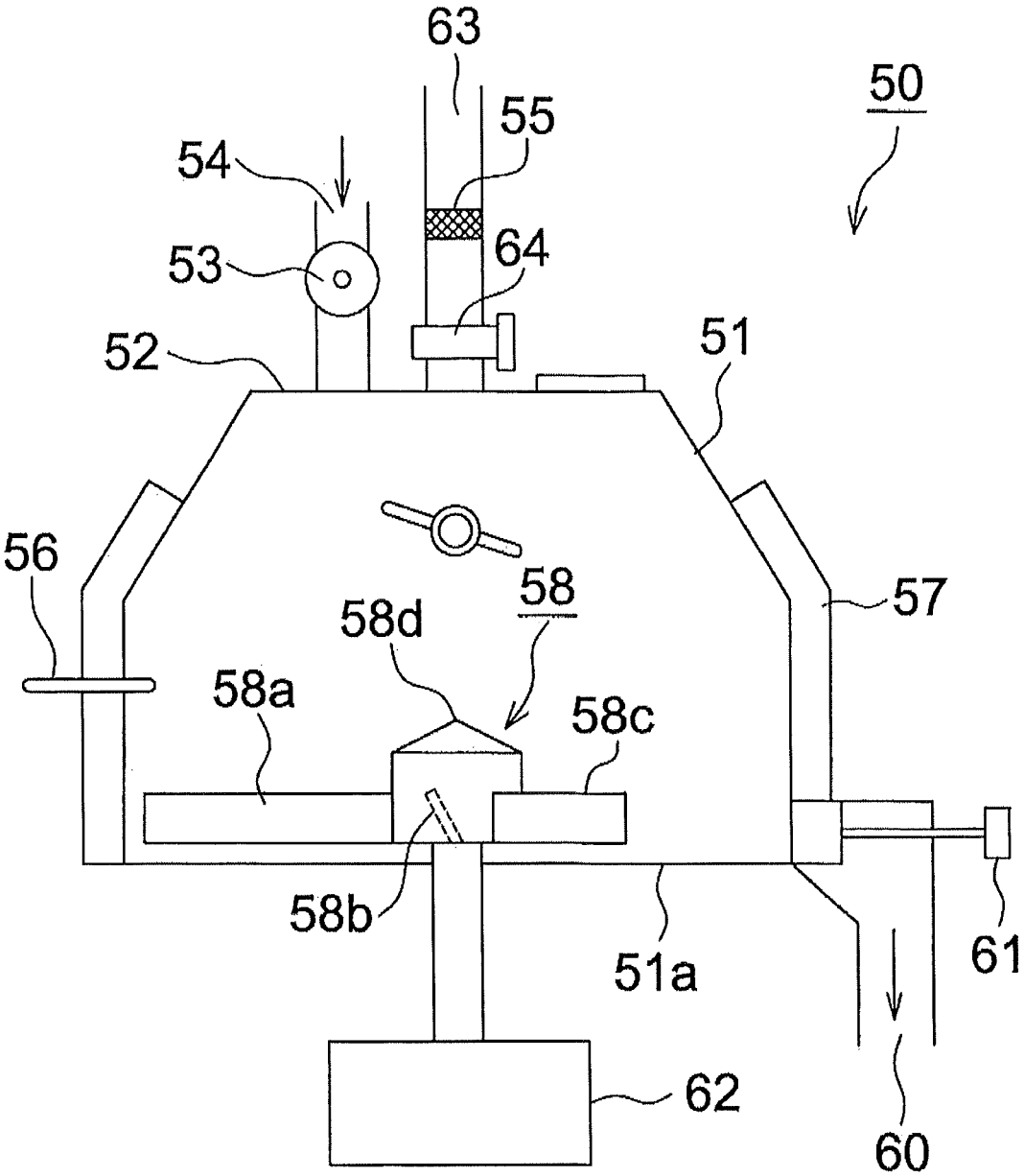
FIG. 1 is a schematic conceptual diagram of a carrier manufacturing apparatus.

Toner for developing an electrostatic latent image according to the present invention will be described below. It is noted that, in the drawings of the present invention, relation of such a dimension as a length, a width, a thickness, or a depth is modified as appropriate for clarity and brevity of the drawings and does not represent actual dimensional relation.

[Toner for Developing Electrostatic Latent Image]

Toner for developing an electrostatic latent image according to the present invention is a dry developer or a liquid developer used in an image formation apparatus of an electrophotography type (such as an image formation apparatus shown in FIG. 2) such as a copying machine, a printer, a digital printer, or a simple printer. The toner for developing an electrostatic latent image according to the present invention contains at least toner particles and may contain other components generally used for toner for developing an electrostatic latent image. Other components can be exemplified, for example, by a carrier and an additive.

<Toner Particles>

Toner particles contained in the toner for developing an electrostatic latent image according to the present invention contain a resin and a pigment, and may further contain other components generally used for toner particles. Other components can be exemplified, for example, by a release agent, a dispersant, a charge control agent, other coloring agents (a coloring agent other than a first pigment, a second pigment, a third pigment, and a fourth pigment which will be described later), and the like. Each constituent element making up such toner particles will be described below.

(Pigment)

The pigment contained in the toner particles in the present invention includes a first pigment and a second pigment, the first pigment is carbon black, and the second pigment is C. I. Pigment Brown 23 and/or C. I. Pigment Brown 25.

It is noted that a "pigment" simply referred to herein is a comprehensive expression (an expression for whole pigment components contained in toner particles) encompassing such first and second pigments (or third and fourth pigments which will be described later).

Thus, the pigment in the present invention exhibits such an excellent effect that dissatisfactory transfer does not take place even though the pigment is contained in toner particles at an extremely high concentration, by containing carbon black representing the first pigment and a specific brown pigment representing the second pigment.

In a case where toner for developing an electrostatic latent image is a dry developer, a pigment is contained preferably by 10 to 50 mass % and more preferably by 15 to 35 mass % in toner particles. As the pigment is contained in the toner particles by 10 mass % or more, proper image density is obtained even though an amount of adhesion is as small as approximately 4.0 g/m$^2$ or less. In addition, according to the present invention, even in a case where the pigment is contained in the toner particles in the dry developer at such a high concentration as 10 mass % or more, dissatisfactory transfer does not take place and an extremely suitable black hue can be exhibited with good color reproducibility. When a pigment exceeding 50 mass % is contained in the toner particles, a content of a resin occupied in the toner particles is small and sufficient fixation strength cannot be obtained.

In a case where toner for developing an electrostatic latent image is a liquid developer, a pigment is contained in toner particles preferably by 20 to 60 mass %. As the pigment is contained in the toner particles by 20 mass % or more, proper image density is obtained even though an amount of adhesion is as small as approximately 3.0 g/m$^2$ or less. In addition, according to the present invention, even in a case where the pigment is contained in the toner particles in the liquid developer at such a high concentration as 20 mass % or more, dissatisfactory transfer does not take place and an extremely suitable black hue can be exhibited with good color reproducibility. When a pigment exceeding 60 mass % is contained in the toner particles, a content of a resin occupied in the toner particles is small and sufficient fixation strength cannot be obtained.

In contrast, for example, in a case where only carbon black is employed as a pigment, when toner particles are filled with the pigment at a high concentration as above, chargeability of the toner particles is impaired because of low electrical resistance of carbon black and dissatisfactory transfer takes place. In particular under such a condition as a high temperature and a high humidity, it is difficult to maintain a stable amount of charging due to influence by moisture in air, and hence dissatisfactory development, dissatisfactory transfer, fogging, or the like takes place, and even image unevenness or lowering in image density is also caused.

When only carbon black and a cyan pigment are used together as the pigment, electrical resistance is not sufficiently controlled by the cyan pigment. Therefore, when a content of the cyan pigment is raised, a proper black hue cannot be obtained to the contrary.

In a case where only carbon black and a yellow pigment representing the fourth pigment as will be described later are used together as the pigment, the problem of dissatisfactory transfer is solved to some extent. On the other hand, since a content of a yellow pigment low in coloring capability becomes high, proper image density is not obtained and a proper black hue cannot be obtained.

Therefore, in order to satisfy image density and a hue and also to prevent the problem of dissatisfactory transfer, it is indispensable to use a specific brown pigment of C. I. Pigment Brown 23 and/or C. I. Pigment Brown 25 representing the second pigment, together with carbon black representing the first pigment. This specific brown pigment is extremely high in coloring capability, its hue is also close to black, and it has high electrical resistance. Therefore, it is considered that such an excellent effect is exhibited and the greatest feature of the present invention is achieved.

It is noted that such a pigment in the present invention is dispersed in a resin in toner particles so that a desired black color tone is obtained. A particle size of such a pigment is preferably not greater than 200 μm and more preferably not greater than 150 μm. When a particle size of the pigment exceeds 200 μm, a color value of an image will deviate and a desired color may not be obtained. Furthermore, since dispersibility of the pigment becomes poor, desired image density may not be obtained either. A lower limit value of a particle size of the pigment is not particularly limited. Each pigment will be described below in further detail.

(First Pigment)

The first pigment is carbon black. Carbon black has high coloring capability and it is necessary in order to obtain desired black image density.

Such a first pigment is contained preferably by 40 to 60 mass % with respect to the total amount of the pigment in toner particles. When a content of the first pigment is lower than 40 mass %, image density tends to lower. When a content of the first pigment exceeds 60 mass %, control of electrical resistance of the toner particles becomes difficult and transfer performance tends to become poor. A content is more preferably from 43 to 57 mass % and further preferably from 45 to 55 mass %.

The reason why carbon black at such a high concentration can be contained in the present invention is because not only carbon black but also a specific brown pigment representing the second pigment are both added to the toner particles, which is a great feature of the present invention.

Here, carbon black is collective denotation of black fine particles mainly composed of carbon. Though carbon black may chemically be categorized as a simple substance of carbon, it can contain various functional groups as is well known. Such carbon black can be exemplified, for example, by thermal black, acetylene black, channel black, furnace black, lamp black, aniline black, and the like, although a type thereof is not particularly limited.

It is noted that such carbon black can be subjected to surface treatment for altering a characteristic of a surface as necessary.

Though conventionally known various methods can be adopted as a treatment method, preferably, a wet type surface treatment method of immersing carbon black in an acid solution such as an acetic acid solution or a sulfonic acid solution or a dry type surface treatment method not using a liquid can be exemplified.

The dry type surface treatment method can be exemplified by a method of brining carbon black in contact with nitric acid, a gas mixture of nitrogen oxide and air, or an oxidizer such as ozone, or an air oxidation method. Some commercially available carbon black has been marketed with its pH having already been adjusted.

Preferred specific examples of carbon black in the present invention can be exemplified by "#2400", "#2400B", "#2650", "OIL7B", "MA-77", "MA-100", "MA-100S", and "PCF#10" manufactured by Mitsubishi Chemical Corporation, "Black Pearls L," "MOGUL-L", "MONARCH 1300", "MONARCH 1400", "REGAL 330R", "REGAL 400R", and "MONARCH 1100" manufactured by Cabot Corporation, "Printex V", "Special Black 4," and "Printex 140V" manufactured by Degussa, and the like (a trade name being shown between quotes " ")

It is noted that one type or two or more types of carbon black can be used as the first pigment of the present invention, and when two or more types of carbon black are used, a total amount thereof is preferably within the range above.

(Second Pigment)

The second pigment is C. I. Pigment Brown 23 and/or C. I. Pigment Brown 25. Thus, the second pigment is a brown pigment shown with a specific color index name. Such a brown pigment is extremely high in coloring capability, its hue is also close to black, and it has high electrical resistance. Therefore, use thereof with carbon black exhibits an excellent effect as described above. Namely, even when this brown pigment is contained at a high concentration in carbon black for control of electrical resistance, image density does not lower or a hue does not differ. Therefore, such excellent effects that electrical resistance can sufficiently be controlled and hence image density and a hue are satisfied and the problem of dissatisfactory transfer can be prevented are exhibited.

A content of such a second pigment is preferably from 25 to 45 mass % and more preferably from 30 to 40 mass % with respect to the total amount of the pigment. When the content of the second pigment is lower than 25 mass %, control of electrical resistance of the toner particles is insufficient and transfer characteristics tend to lower.

When a content of the second pigment exceeds 45 mass %, image density is insufficient, a hue of the toner particles is close to a hue of the brown pigment, and a desired black hue does not tend to be obtained. It is noted that, when two types of brown pigments are used as the second pigment, the total amount thereof is preferably within the range above.

For example, commercially available pigments as below can be used as such a brown pigment. Namely, "PV Fast Brown HFR" (a trade name of C. I. Pigment Brown 25, manufactured by Clariant Japan K. K.), "Cromophtal (trademark) Brown 5R" (a trade name of C. I. Pigment Brown 23, manufactured by BASF), and the like can be exemplified.

(Content of First Pigment and Second Pigment)

As described above, the toner for developing an electrostatic latent image according to the present invention preferably contains the first pigment by 40 to 60 mass % with respect to the total amount of the pigment, and contains the second pigment by 25 to 45 mass % with respect to the total amount of the pigment. Thus, such excellent effects that image density and a hue are satisfied and the problem of dissatisfactory transfer is also prevented can more effectively be exhibited.

In this case, the upper limit of the total amount of the first pigment and the second pigment is 100 mass % with respect to the total amount of the pigment, and the pigment can consist of the first pigment and the second pigment. On the other hand, as such a pigment, together with the first pigment and the second pigment, a third pigment and/or a fourth pigment as below can also further be contained.

(Third Pigment)

A third pigment is C. I. Pigment Blue 15:3 and/or C. I. Pigment Blue 15:4. Thus, the third pigment is a cyan pigment shown with a specific color index name. Such a cyan pigment can be used mainly for the purpose of control of a hue.

A content of such a third pigment is preferably from 2 to 10 mass % and more preferably from 5 to 8 mass % with respect to the total amount of the pigment. When a content of the third pigment is lower than 2 mass %, hue control does not tend to be optimal (since an amount of cyan is small, a hue is reddish), and when a content thereof exceeds 10 mass %, hue control does not tend to be optimal (since an amount of cyan is too large, a hue is bluish). It is noted that, when two types of cyan pigments are used as the third pigment, the total amount thereof is preferably within the range above.

For example, a commercially available pigment as below can be used as such a cyan pigment. Namely, "Fastogen Blue GNPT" (a trade name of C. I. Pigment Blue 15:3, manufactured by DIC Corporation), "Cyanine Blue 4933GN-EP," "Cyanine Blue 4940," and "Cyanine Blue 4973" (manufactured by Dainichiseica Color & Chemicals Mfg. Co., Ltd.), "Fastogen Blue GNPS-G" (manufactured by DIC Corporation) (each of which is a trade name of C. I. Pigment Blue 15:4), and the like can be exemplified.

(Fourth Pigment)

A fourth pigment is at least one type of a yellow pigment selected from the group consisting of C. I. Pigment Yellow 74, C. I. Pigment Yellow 155, C. I. Pigment Yellow 180, and C. I. Pigment Yellow 185. Thus, the fourth pigment is a yellow pigment shown with a specific color index name. Such a yellow pigment can be used mainly for the purpose of control of a hue.

A content of such a fourth pigment is preferably from 2 to 20 mass % and more preferably from 5 to 15 mass % with respect to the total amount of the pigment. When a content of the fourth pigment is lower than 2 mass %, hue control does not tend to be optimal, and when a content thereof exceeds 20 mass %, a ratio of a yellow pigment occupied in the entire pigment is high and desired image density (ID) does not tend to be obtained. It is noted that, when two or more types of yellow pigments are used as the fourth pigment, the total amount thereof is preferably within the range above.

For example, a commercially available pigment as below can be used as such a yellow pigment. Namely, "Seikafast Yellow 2054" (a trade name of C. I. Pigment Yellow 74, manufactured by Dainichiseica Color & Chemicals Mfg. Co., Ltd.), "Graphtol Yellow 3GP" (a trade name of C.I. Pigment Yellow 155, manufactured by Clariant Japan K. K.), "Toner Yellow HG" (a trade name of C. I. Pigment Yellow 180, manufactured by Clariant Japan K. K.), "PALIOTOL YELLOW D 1155" (a trade name of C. I. Pigment Yellow 185, manufactured by BASF), and the like can be exemplified.

(As to Hue)

Normally, a hue can be expressed with each value on an L* axis, an a* axis, and a b* axis in a uniform color space of an L*a*b* colorimetric system defined under JIS Z 8729. An ideal hue of a black image can be exemplified by a hue shown in Japan Color Color Reproduction Printing 2001 defined as the color standard for offset sheet-fed printing (paper type: coated paper, manner: a site attaining a black dot area ratio of 100%).

In general, an acceptable color difference is presented as $\Delta E<6$ and more preferably as $\Delta E<3$. It is noted that $\Delta E$ is a color difference between a certain color and another color in the uniform color space in the L*a*b* colorimetric system defined under JIS Z 8729 and it is expressed as a square root of the sum of squares of differences on the L* axis, the a* axis, and the b* axis.

When only carbon black representing the first pigment is used as the pigment, relation of $\Delta E<6$ is satisfied and a proper hue is achieved. When only a brown pigment is added to carbon black to thereby control electrical resistance, however, there is a case that relation of $\Delta E<6$ cannot be achieved due to the influence by a hue of the brown pigment. In such a case, addition of the third pigment and/or the fourth pigment above allows relation of $\Delta E<6$ to be satisfied, which is preferred.

(Resin)

As a resin to be contained in the toner particles in the present invention, a resin conventionally known as a resin used for this type of application can be used without particularly limited. For example, a polyester resin, an acrylic resin, a styrene acrylic based copolymer resin, a urethane resin, a vinyl chloride resin, a vinyl acetate resin, an epoxy resin, an amide resin, a melamine resin, a phenol resin, an aniline resin, a urea resin, a silicon resin, an imide resin, and the like can be exemplified. Whether the toner for developing an electrostatic latent image according to the present invention is a dry developer or a wet developer, a resin as described above can be used as a resin to be contained in toner particles.

(Release Agent)

A wax can preferably be used as a release agent. Known waxes shown below are exemplified as waxes which can be used for the toner for developing an electrostatic latent image according to the present invention. Namely, a polyolefin based wax such as a polyethylene wax and a polypropylene wax; a long-chain hydrocarbon based wax such as a paraffin wax and sasolwax; a dialkyl ketone based wax such as distearyl ketone; an ester based wax such as a carnauba wax, a montan wax, trimethylolpropane tribehenate, pentaerythritol tetramyristate, pentaerythritol tetrastearate, pentaerythritol tetrabehenate, pentaerythritol diacetate dibehenate, glycerin tribehenate, 1,18-octadecanediol distearate, tristearyl trimellitate, and distearyl maleate; and an amide based wax such as ethylenediamine dibehenyl amide and trimellitic acid tristearylamide are exemplified.

A wax has a melting point normally from 40 to 125° C., preferably from 50 to 120° C., and more preferably from 60 to 90° C. By setting the melting point within the range above, heat-resistant storage capability of toner is ensured and stable toner image formation can be achieved without causing cold offset or the like even in a case of fixation at a low temperature. A content of a wax in toner particles is preferably from 1 to 30 mass % and more preferably from 5 to 20 mass %.

(Method of Manufacturing Toner Particles)

The toner particles according to the present invention can be fabricated with a conventional toner manufacturing method, without particularly limited. Namely, the toner particles can be fabricated with what is called a crushing method in which toner particles are fabricated through mixing and kneading, crushing, and classifying steps and what is called a polymerization method in which a polymeric monomer is polymerized and at the same time particles are formed while a shape and a size are controlled.

Among these, toner fabrication with the polymerization method can form desired toner while a shape and a size of particles are controlled through a manufacturing process thereof and it is optimal for fabrication of small-diameter toner capable of faithfully reproducing a small dot image. The toner particles can be manufactured, for example, so as to have a core-shell structure. The toner particles having a core-shell structure are constituted of core particles formed of a resin containing a pigment and shells formed of a resin covering surfaces of the core particles, and the core particles and the shells may contain other components contained in general toner particles. According to the core-shell structure, as the core particles contain a pigment, exposure of a pigment at the surfaces of the toner particles is suppressed and resistance to filming can be improved, which is preferred. The toner particles having the core-shell structure are not limited to those having such a structure that the core particles are completely covered with the shells, and the surfaces of the core particles may partially be exposed.

<Additive>

The toner for developing an electrostatic latent image according to the present invention preferably contains an additive. By adding an additive to toner particles, fluidity of the toner for developing an electrostatic latent image can be improved. A known additive can be used as the additive, and inorganic oxide particles subjected to hydrophobization treatment such as silica, titania, and aluminum oxide can be used. An amount of addition of an additive is preferably from 0.1 to 10 part(s) by mass with respect to 100 parts by mass of toner particles.

<Carrier>

A carrier may be contained as necessary in the toner for developing an electrostatic latent image according to the present invention. In a case where the toner for developing an electrostatic latent image is employed as a dry developer, a carrier is not particularly restricted and a known carrier can be used. Specifically, a resin-coated carrier described in Japanese Laid-Open Patent Publication No. 62-39879, Japanese Laid-Open Patent Publication No. 56-11461, or the like is preferably used.

Alternatively, in a case where the toner for developing an electrostatic latent image is employed as a dry developer, a one-component developer made of toner particles composed of one component may be employed. In a case of a one-component developer, it can be used either as a magnetic one-component developer containing metal particles in toner particles or a non-magnetic one-component developer not containing magnetic metal particles in toner.

In a case where the toner for developing an electrostatic latent image is employed as a liquid developer, an insulating liquid is employed as a carrier. An insulating liquid preferably has a resistance value to such an extent as not disturbing an electrostatic latent image (from $10^{11}$ to $10^{16}$ Ω·cm). In addition, an insulating liquid not having odor and toxicity is preferred.

For example, aliphatic hydrocarbon, cycloaliphatic hydrocarbon, aromatic hydrocarbon, halogenated hydrocarbon, polysiloxane, and the like can be exemplified as such an insulating liquid. In particular, in terms of odor, harmlessness, and cost, a normal paraffin based solvent and an isoparaffin based solvent are preferred. Specifically, Moresco White (trade name, manufactured by Matsumura Oil Research Corp.), Isopar (trade name, manufactured by Exxon Chemicals), Shellsol (trade name, manufactured by Shell Sekiyu K.K.), IP Solvent 1620 and IP Solvent 2028 (each of which is a trade name, manufactured by Idemitsu Petrochemical Co., Ltd.), and the like can be exemplified.

[First Embodiment]

Toner for developing an electrostatic latent image according to the present embodiment is a dry developer containing toner particles having a core-shell structure and a resin-coated carrier.

<Toner Particles>

A method of forming resin particles in advance with such a polymerization method as an emulsion polymerization method or a suspension polymerization method and forming particles by aggregating and fusing these resin particles is preferred as a method of manufacturing toner particles having a core-shell structure.

In the emulsion polymerization method, toner particles having a core-shell structure are fabricated generally through the following procedures. Namely, (1) a step of fabrication of a dispersion solution of resin particles for cores, (2) a step of fabrication of a dispersion solution of pigment particles, (3) a step of aggregation and fusion of the resin particles for cores (step of fabricating core particles), (4) a first aging step, (5) a step of cover with shells, (6) a second aging step, (7) a cooling step, (8) a cleaning step, (9) a drying step, and

(10) a step of treatment with an additive are sequentially performed.

In the present embodiment, in fabricating core particles, a heating temperature is set to be slightly high and a time period for fusion is set to be slightly long in the step of aggregation and fusion, so that aggregated resin particles are in a rounded shape and at the same time a smooth surface is formed. In addition, by setting a heating temperature in the aging step of subjecting a reaction system to heating treatment subsequent to the step of aggregation and fusion to be slightly high and setting a time period therefor to be slightly long as well, core particles having a smooth surface can be fabricated.

Each step will be described hereinafter, by way of example of toner particles having a core-shell structure, which are obtained by covering surfaces of the core particles containing a styrene acrylic copolymer resin with a modified polyester resin in which a styrene acrylic copolymer molecular chain has been molecularly bonded to a terminal of a polyester molecular chain, to thereby form shells.

(1) Step of Fabrication of a Dispersion Solution of Resin Particles for Cores

In this step, a styrene monomer forming resin particles for cores and an acrylic acid ester monomer are introduced and dispersed in a water based medium together with a surfactant, and a polymerization initiator is added for polymerization, so that resin fine particles for cores composed of a styrene acrylic copolymer are formed. The resin fine particles have a volume average particle size preferably from 50 to 300 nm. Styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene, and the like are exemplified as suitable styrene monomers.

A suitable acrylic acid ester monomer is represented by an acrylic acid ester monomer and a methacrylic acid ester monomer shown below, and an acrylic acid ester monomer is exemplified, for example, by methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, and the like. A methacrylic acid ester monomer is exemplified, for example, by methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, dimethylaminoethyl methacrylate, and the like.

The acrylic acid ester monomer or the methacrylic acid ester monomer can be used alone, and in addition, two or more types thereof as combined can also be used. Namely, any of formation of a copolymer by using a styrene monomer and two or more types of acrylic acid ester monomers, formation of a copolymer by using a styrene monomer and two or more types of methacrylic acid ester monomers, and formation of a copolymer by using a styrene monomer as well as an acrylic acid ester monomer and a methacrylic acid ester monomer together is possible.

(2) Step of Fabrication of a Dispersion Solution of Pigment Particles

In this step, a pigment is introduced and dispersed in a water based medium together with a surfactant to thereby fabricate a dispersion solution of pigment particles. The pigment particles have a volume average particle size preferably from 50 to 200 nm.

(3) Step of Aggregation and Fusion of the Resin Particles for Cores (Step of Fabricating Core Particles)

In this step, the resin particles and the pigment particles described previously are aggregated in a water based medium and these particles are fused simultaneously with aggregation, to thereby fabricate the core particles. An amount of addition of the pigment particles in this step is preferably from 10 to 40 mass % with respect to the total amount of toner particles (including also a material added in a subsequent stage) in solid content equivalent. In this step, after alkali metal salt, alkaline earth metal salt, or the like is added as a flocculating agent to the water based medium in which the resin particles and the pigment particles have been mixed, aggregation is caused to proceed through heating at a temperature not lower than a glass transition temperature of the resin particles and simultaneously the resin particles are fused with one another.

Specifically, by adding the resin particles and the pigment particles fabricated in the procedure described previously to the reaction system and adding a flocculating agent such as magnesium chloride, the resin particles and the pigment particles are aggregated and simultaneously the particles are fused with one another, so that aggregated resin particles (core particles) are formed. Then, at the time point when the core particles have grown to a target size, aggregation is stopped by adding salt such as saline. The core particles have a volume average particle size preferably from 3.0 to 7.0 μm.

In this step, a heating temperature is set to be slightly high and a time period for fusion is set to be slightly long, so that the aggregated resin particles (core particles) are in a rounded shape and simultaneously a surface is smoothened. The core particles having a smooth surface can thus be fabricated.

(4) First Aging Step

In this step, aging is carried out until the core particles achieve a desired shape, by subjecting the reaction system to heating treatment subsequent to the step of aggregation and fusion above. In this step as well, by setting a heating temperature to be slightly high and setting a time period for treatment to be slightly long, the core particles having a smooth surface can be fabricated.

(5) Step of Cover with Shells

In this step, shells are formed by adding resin particles for shell formation to the dispersion solution of the core particles formed in the first aging step, to thereby cover the surfaces of the core particles with the resin particles. In the present embodiment, in this step, resin particles of modified polyester in which a styrene acrylic copolymer molecular chain is molecularly bonded to a terminal of a polyester molecular chain are added to thereby form shells containing the modified polyester. As a suitable polyester molecule used here, polyester molecules having such a structure that a styrene acrylic copolymer molecular chain (also referred to as a styrene acrylic copolymer segment) is molecularly bonded to a polyester molecular chain (also referred to as a polyester segment) can be exemplified. Among these, a polyester molecule of which content of a styrene acrylic copolymer segment is not lower than 5 mass % and not higher than 30 mass % is preferred. Here, a content of a styrene acrylic copolymer segment occupied in a styrene acrylic modified polyester molecule is also referred to as a "styrene acrylic modified amount," and it represents a ratio (a mass ratio) of the styrene acrylic copolymer segment occupied in the styrene acrylic modified polyester molecule. Specifically, it refers to a ratio of a mass of a polymeric monomer used for forming a styrene acrylic copolymer to a total mass of a polymeric monomer used in synthesizing a styrene acrylic modified polyester resin. By setting the "styrene acrylic modified amount" to the range above, the shells described above can more reliably be formed.

It is considered that, by using modified polyester in which a styrene acrylic copolymer molecular chain is molecularly bonded to a polyester molecular chain as a resin for forming shells, moderate affinity to the surfaces of the core particles is expressed and firm bond is formed. In addition, it is also considered that moderate dispersibility acts between resin particles for forming the shells and hence aggregation among the resin particles for forming the shells is less likely and thin shells are formed on the surfaces of the core particles. The toner particles having the core-shell structure are thus formed. An amount of addition of the resin particles of modified polyester in the step of cover with shells is preferably selected such that formed shells have a thickness approximately from 20 to 500 nm. Specifically, an amount of addition of the resin particles for forming the shells is preferably from 1 to 40 mass % and preferably from 5 to 30 mass % in the total amount of toner particles, in solid content equivalent.

(6) Second Aging Step

In this step, covering of the core surfaces with the shells is strengthened by subjecting the reaction system to heating treatment subsequent to the step of cover with shells above and aging is carried out until the toner particles achieve a desired shape.

(7) Cooling Step

This step is a step of subjecting the dispersion solution of the toner particles to cooling treatment (rapid cooling treatment). With regard to a cooling treatment condition, cooling is performed at a cooling rate preferably from 1 to 20° C./min. A method for cooling treatment is not particularly limited, and a method of cooling by introducing a coolant from the outside of a reaction vessel and a method of cooling by introducing cold water directly into a reaction system can be exemplified.

(8) Cleaning Step

In this step, the toner particles are subjected to solid-liquid separation from the dispersion solution of the toner particles cooled to a prescribed temperature in the step above, and cleaning is carried out in order to remove such deposits as a surfactant and a flocculating agent from the surfaces of the toner particles formed into a lump like a wet cake as a result of solid-liquid separation. In the cleaning treatment, water cleaning treatment is performed until electrical conductivity of a filtrate attains, for example, to a level of 10 μS/cm. Known treatment methods such as a centrifugation method, a reduced-pressure filtering method performed with the use of a Nutsche or the like, and a filtering method with the use of a filter press are available as methods for filtering treatment, without particularly limited.

(9) Drying Step

In this step, the toner particles subjected to cleaning treatment are subjected to drying treatment to thereby obtain dry toner particles. Known dryers such as a spray dryer, a vacuum freeze dryer, and a reduced-pressure dryer are exemplified as a dryer used in this step, and a stationary shelf dryer, a moving shelf dryer, a fluidized bed dryer, a rotary dryer, an agitation dryer, and the like can also be used. An amount of moisture contained in the toner particles subjected to drying treatment is preferably not higher than 5 mass % and more preferably not higher than 2 mass %. It is noted that, in a case where the toner particles subjected to drying treatment aggregate owing to weak interparticle attraction, the aggregate may be subjected to cracking treatment. Here, a mechanical cracking apparatus such as a jet mill, a Henschel mixer, a coffee mill, and a food processor can be used as a cracking treatment apparatus.

(10) Step of Treating with an Additive

In this step, after the toner particles are subjected to drying treatment, an additive is added and mixed as necessary to thereby add the additive to the surfaces of the toner particles. An additive formed from monodisperse spherical particles having a number average primary particles size not smaller than 5 nm and not greater than 150 nm is preferably employed as the additive. Herein, the toner particles before addition of an additive may be referred to as "toner base particles" and the toner particles after addition of the additive may be referred to as "additive-added toner particles" for distinction. It is noted that a mass of the toner particles herein refers to a mass of the "toner base particles."

Through the steps above, the toner particles having the core-shell structure can be fabricated with the emulsion polymerization method. It is noted that, in the steps above, the core particles not subjected to the step of cover with shells can also be employed as they are as the toner particles for the toner for developing an electrostatic latent image according to the present invention.

A flocculating agent, a polymerization initiator, a dispersion stabilizer, a surfactant, and the like used for a case where the toner particles according to the present embodiment are fabricated with the emulsion polymerization method will now be described.

(Flocculating Agent)

In (3) the step of aggregation and fusion of the resin particles for cores, the resin particles, the pigment particles, and the like are preferably aggregated by using a flocculating agent. Though a flocculating agent which can be used in the present embodiment is not particularly limited, a flocculating agent selected from metal salts is suitably used. For example, salt of a monovalent metal such as salt of an alkali metal including sodium, potassium, and lithium, salt of a divalent metal such as calcium, magnesium, manganese, and copper, salt of a trivalent metal such as iron and aluminum, and the like are exemplified. Sodium chloride, potassium chloride, lithium chloride, calcium chloride, magnesium chloride, zinc chloride, copper sulfate, magnesium sulfate, manganese sulfate, and the like are exemplified as specific salts, and salt of a divalent metal is particularly preferred among these. By using salt of a divalent metal, aggregation can proceed with a smaller amount. One type or two or more types of these as combined may be used.

(Polymerization Initiator)

In a case of forming the resin particles by using a vinyl based polymeric monomer in (1) the step of fabrication of a dispersion solution of resin particles for cores, a known oil-soluble or water-soluble polymerization initiator can be used. Specifically, an azo based or diazo based polymerization initiator or a peroxide based polymerization initiator shown below is specifically exemplified as an oil-soluble polymerization initiator. Namely, an azo based or diazo based polymerization initiator such as 2,2'-azobis-(2,4-dimethyl valeronitrile), 2,2'-azobisisobutyronitrile, 1,1'-azobis (cyclohexane-1-carbonitrile), 2,2'-azobis-4-methoxy-2,4-dimethyl valeronitrile, and azobisisobutyronitrile; and a peroxide based polymerization initiator such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexyl) propane, and tris-(t-butylperoxy)triazine are exemplified.

In a case of forming the resin particles with the emulsion polymerization method, a water-soluble radical polymerization initiator can be used. Persulfate such as potassium persulfate and ammonium persulfate, azobisaminodipropanacetate, azobis cyanovaleric acid and salt thereof, hydrogen peroxide, and the like are available as a water-soluble polymerization initiator.

A known chain transfer agent can also be used for adjustment of a molecular weight of resin particles. Specifically, octyl mercaptan, dodecyl mercaptan, tert-dodecyl mercaptan, n-octyl-3-mercaptopropionic acid ester, terpinolene, carbon tetrabromide, α-methylstyrene dimer, and the like are available.

(Dispersion Stabilizer)

In the present embodiment, in (3) the step of aggregation and fusion of the resin particles for cores, the toner particles are fabricated by aggregating and fusing the resin particles, the pigment particles, and the like dispersed in the water based medium. In this step, a dispersion stabilizer for dispersing materials for the toner particles in the water based medium in a stable manner is preferably used. For example, tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, alumina, and the like are available as a dispersion stabilizer. In addition, a substance generally used as a surfactant such as polyvinyl alcohol, gelatin, methyl cellulose, sodium dodecylbenzenesulfonate, an ethylene oxide adduct, and higher alcohol sodium sulfate can also be used as a dispersion stabilizer.

(Surfactant)

In the present embodiment, in (1) the step of fabrication of a dispersion solution of resin particles for cores, a polymeric monomer dispersed in a water based medium is polymerized. In this step, a surfactant is preferably used for uniformly dispersing an oil drop of a polymeric monomer in a water based medium. Though a surfactant used here is not particularly limited, for example, an ionic surfactant shown below can be used as a preferred surfactant. Ionic surfactants include sulfonate, sulfuric acid ester salt, fatty acid salt, and the like.

For example, sodium dodecylbenzenesulfonate, aryl alkyl polyether sodium sulfonate, 3,3-disulfone diphenylurea-4,4-diazo-bis-amino-8-naphthol-6-sodium sulfonate, o-carboxybenzene-azo-dimethylaniline, 2,2,5,5-tetramethyl-triphenylmethane-4,4-diazo-bis-β-naphthol-6-sodium sulfonate, and the like are exemplified as suitable sulfonate.

For example, sodium lauryl sulfate, sodium dodecyl sulfate, sodium tetradecyl sulfate, sodium pentadecyl sulfate, sodium octyl sulfate, and the like are available as suitable sulfuric acid ester salt, and sodium oleate, sodium laurate, sodium caprate, sodium caprylate, sodium caproate, potassium stearate, calcium oleate, and the like are exemplified as fatty acid salt.

A nonionic surfactant can also be used, and specifically, polyethylene oxide, polypropylene oxide, combination of polypropylene oxide and polyethylene oxide, ester of polyethylene glycol and higher fatty acid, alkylphenol polyethylene oxide, ester of higher fatty acid and polyethylene glycol, ester of higher fatty acid and polypropylene oxide, sorbitan ester, and the like are exemplified.

<Resin-Coated Carrier>

The toner for developing an electrostatic latent image in the present embodiment is a two-component developer, and it contains a resin-coated carrier together with toner particles. The resin-coated carrier is formed by covering surfaces of magnetic core material particles (hereinafter also referred to as core material particles) with a resin, and the carrier has a volume average particle size preferably not smaller than 25 μm and not greater than 50 μm. The resin-coated carrier can express good performance of charging the toner particles in a stable manner, owing to a resin-coating layer formed on a surface of the carrier.

The resin-coated carrier can be fabricated, for example, by using a carrier manufacturing apparatus which is a horizontal rotor blade type mixer of which schematic conceptual diagram is shown in FIG. 1. In the carrier manufacturing apparatus in FIG. 1, the resin-coated carrier is fabricated by mixing and stirring core material particles and resin particles to thereby electrostatically adhere the resin particles on surfaces of the core material particles, applying stress to the core material particles to which the resin particles have adhered while they are heated, and spreading the resin particles over the surfaces of the magnetic core material particles and cover the surfaces with the resin particles.

A carrier manufacturing apparatus 50 shown in FIG. 1 has a container main body 51 corresponding to a mixing tank and a circumferential surface of container main body 51 is covered with a thermostatic jacket 57 to a height of substantially ¾ thereof. A bottom portion 51*a* of container main body 51 (also referred to as a container bottom portion) has a rotary vane 58 for stirring and an outlet 60 for taking out the fabricated resin-coated carrier, and an exhaust valve 61 is arranged at outlet 60. A main body upper lid 52 is provided on an upper surface of container main body 51, a source material inlet port 54 provided with an inlet valve 53 and a filter 55 are provided at main body upper lid 52, an exhaust valve 64 is arranged between filter 55 and container upper lid 52, and an exhaust port 63 into a container is provided ahead of filter 55.

The core material particles and the resin particles which are source materials for fabricating the resin-coated carrier are supplied to the inside of container main body 51 through source material inlet port 54. It is noted that the inside of container main body 51 where the resin-coated carrier is actually fabricated is referred to as a chamber and a thermometer 56 for measuring a temperature in the chamber is arranged around the circumferential surface of container main body 51.

Rotary vane 58 described previously stirs the core material particles and the resin particles as it is rotated by a motor 62 representing drive means, and stirring vanes 58*a*, 58*b*, and 58*c* are coupled at an angular interval of 120° from one another in a central portion 58*d* of rotary vane 58. These stirring vanes are attached as inclined with respect to a surface of bottom portion 51*a*, and when stirring vanes 58*a*, 58*b*, and 58*c* rotate at a high speed, such source materials as the core material particles and the resin particles described previously are stirred up and collide against an upper inner wall of main body container 51 and fall.

Motor 62 rotating rotary vane 58 representing stirring means is connected to not-shown control means represented by a computer, and the control means controls actuation of motor 62 based on a stored program.

For example, carrier manufacturing apparatus 50 in FIG. 1 can stepwise perform an operation for electrostatically adhere the resin particles to the surfaces of the core material particles and an operation for strongly securing the electrostatically adhering resin particles to the surfaces of the core material particles, by controlling actuation of rotary vane 58 described previously. The carrier manufacturing apparatus in FIG. 1 can fabricate the resin-coated carrier at least through the following steps. Namely, (1) the step of stirring and mixing the core material particles and the resin particles at room temperature to thereby adhere the resin particles to the surfaces of the core material particles owing to an action of static electricity, (2) the step of spreading the resin particles over the surfaces of the core material particles and covering the same by applying mechanical impact while the chamber is heated to a temperature not lower than a glass transition temperature of the resin particles, to thereby form resin coating layers, and (3) the step of cooling the chamber to room temperature are sequentially performed.

Through at least the steps of (1) to (3) above, the resin-coated carrier having such a structure that surfaces of core material particles are coated with a resin can be fabricated. In addition, the steps of (1) to (3) above can be repeated a plurality of times as necessary.

Iron powders, magnetite, various ferrite based particles, or particles in which the former is dispersed in a resin can be exemplified as the core material particles. Magnetite and various ferrite based particles are preferred. Ferrite containing such a heavy metal as copper, zinc, nickel, and manganese or light metal ferrite containing an alkali metal and/or an alkaline earth metal is preferred as ferrite.

As the resin particles for coating, a polyolefin based resin such as polyethylene, polypropylene, chlorinated polyethylene, and chlorosulfonated polyethylene; a polyvinyl and polyvinylidene based resin such as polystyrene, polyacrylate such as polymethylmethacrylate, polyacrylonitrile, polyvinyl acetate, polyvinyl alcohol, polyvinyl butyral, polyvinyl chloride, polyvinyl carbazole, polyvinyl ether, and polyvinyl ketone; a copolymer such as a vinyl chloride-vinyl acetate copolymer and a styrene-acrylic acid copolymer; a silicone resin or a modified resin thereof formed by an organosiloxane bond (such as a modified resin of an alkyd resin, a polyester resin, an epoxy resin, and polyurethane); a fluororesin such as polytetrachloroethylene, polyvinyl fluoride, polyvinylidene fluoride, and polychlorotrifluoroethylene; polyamide; polyester; polyurethane; polycarbonate; an amino resin such as a urea-formaldehyde resin; an epoxy resin; and the like are used.

More preferably, a resin of an alkyl methacrylate base and having an alkyl group branched to a secondary or tertiary alkyl group can achieve a suited amount of contained water and can keep high charge retention capability. Here, an alkyl group desirably has a carbon number from 3 to 8, and more preferably an alkyl group desirably has a cyclic structure. This is because, by selecting a resin having this structure, charging capability of a carrier and a glass transition temperature of a coating layer can be accommodated in a more proper range. As a specific compound, 2-ethyl hexyl methacrylate, isobutyl methacrylate, cyclopropyl methacrylate, cyclobutyl methacrylate, cyclopentyl methacrylate, cyclohexyl methacrylate, cycloheptyl methacrylate, and the like are available, and among these, cyclohexyl methacrylate is particularly preferred.

[Image Formation Apparatus]

Figure 2:
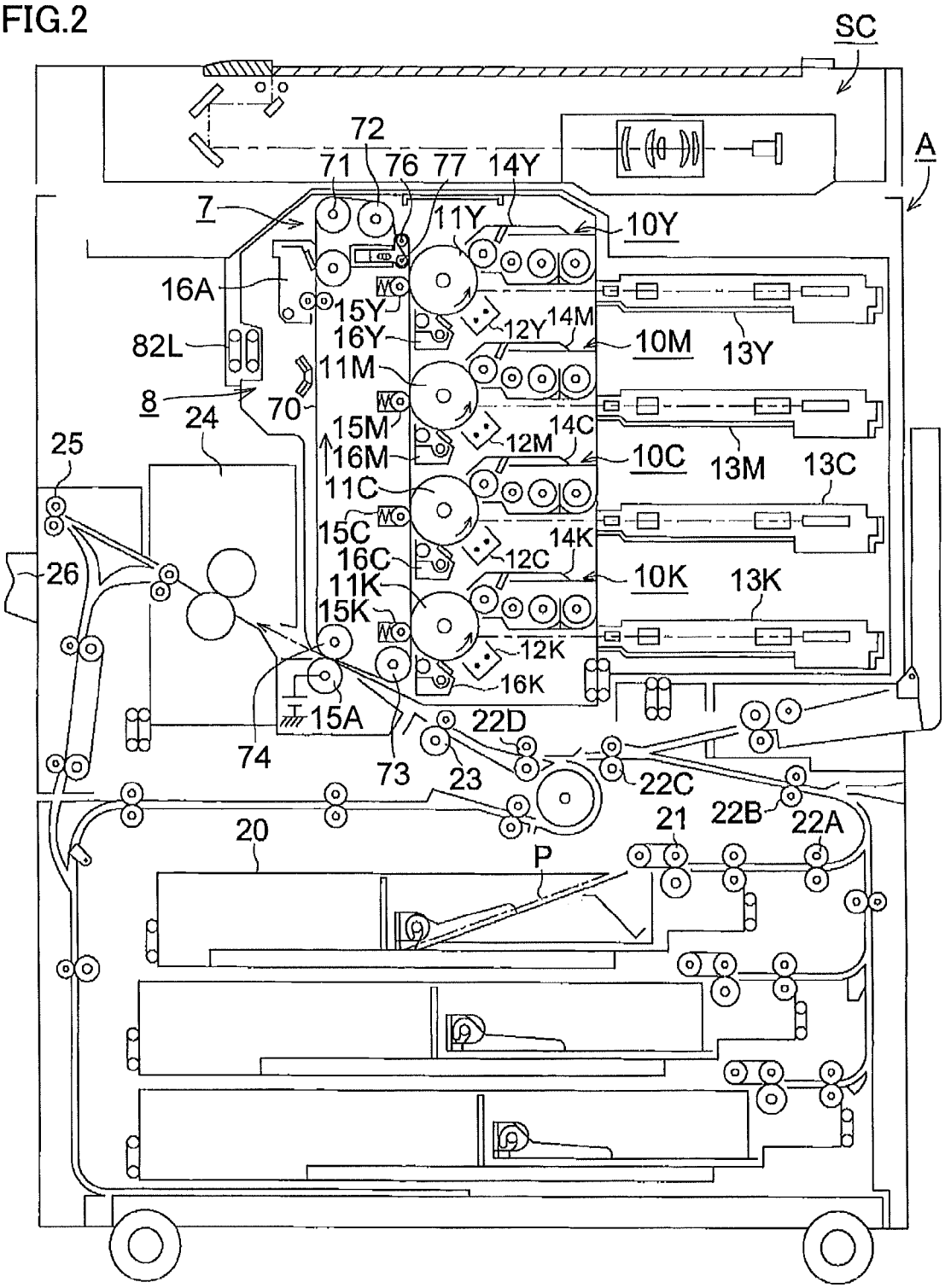
FIG. 2 is a schematic conceptual diagram of an image formation apparatus of an electrophotography type.

FIG. 2 is a schematic diagram showing one example of an image formation apparatus which can be used at the time when a two-component dry developer is employed as the toner for developing an electrostatic latent image according to the present invention.

FIG. 2 shows photoconductors 11Y, 11M, 11C, 11K, development apparatuses 14Y, 14M, 14C, 14K, primary transfer rolls 15Y, 15M, 15C, 15K serving as primary transfer means, a secondary transfer roll 15A serving as secondary transfer means, cleaning apparatuses 16Y, 16M, 16C, 16K, an intermediate transfer element unit 7, a heat roll fixation apparatus 24, and an intermediate transfer element 70.

This image formation apparatus is called a tandem type color image formation apparatus, and it has a plurality of sets of image formation portions 10Y, 10M, 10C, 10K, endless belt type intermediate transfer element unit 7 serving as a transfer portion, and endless belt type paper feed transportation means 21 for transporting a recording member P and heat roll fixation apparatus 24 as fixation means. A document image scanner SC is arranged in an upper portion of a main body A of the image formation apparatus.

Image formation portion 10Y forming a yellow image as one of toner images in a different color formed in each photoconductor has drum-shaped photoconductor 11Y serving as a first photoconductor, charging means 12Y arranged around photoconductor 11Y, exposure means 13Y, development means 14Y, primary transfer roll 15Y serving as the primary transfer means, and cleaning apparatus 16Y.

Preferably, cleaning apparatus 16Y is provided with a cleaning blade which is a main cleaning member and equipped with a cleaning roller brought in contact with transfer residue toner before removal of transfer residue toner by the cleaning blade. The cleaning roller is preferably a roller in which a surface of a cored bar is covered with such an elastic body as silicone rubber or urethane foam. A cleaning roller which follows the photoconductor in a manner in contact therewith suffices, however, a cleaning roller driven at a speed 1.1 to 2.0 times as high as a peripheral speed of the photoconductor is preferred, because occurrence of filming can be prevented without causing abrasion of a surface of the photoconductor.

In addition, image formation portion 10M forming a magenta image as one of toner images in another different color has drum-shaped photoconductor 11M serving as the first photoconductor, charging means 12M arranged around photoconductor 11M, exposure means 13M, development means 14M, primary transfer roll 15M serving as the primary transfer means, and cleaning apparatus 16M. It is noted that cleaning apparatus 16M is desirably the same in construction as cleaning apparatus 16Y described previously. Moreover, image formation portion 10C forming a cyan image as one of toner images in another different color has drum-shaped photoconductor 11C serving as the first photoconductor, charging means 12C arranged around photoconductor 11C, exposure means 13C, development means 14C, primary transfer roll 15C serving as the primary transfer means, and cleaning apparatus 16C. It is noted that cleaning apparatus 16C is desirably the same in construction as cleaning apparatus 16Y described previously.

Furthermore, image formation portion 10K forming a black image as one of toner images in another different color has drum-shaped photoconductor 11K serving as the first photoconductor, charging means 12K arranged around photoconductor 11K, exposure means 13K, development means 14K, primary transfer roll 15K serving as the primary transfer means, and cleaning apparatus 16K. It is noted that cleaning apparatus 16K is desirably the same in construction as cleaning apparatus 16Y described previously.

Endless belt type intermediate transfer element unit 7 has endless belt type intermediate transfer element 70 serving as a second image carrier of an intermediate transfer endless belt type wound around and circulatably supported by a plurality of rolls.

Images of respective colors formed by image formation portions 10Y, 10M, 10C, 10K are successively transferred onto circulating endless belt type intermediate transfer element 70 by primary transfer rolls 15Y, 15M, 15C, 15K, so that a combined color image is formed. Recording member P such as paper serving as a transfer material accommodated in a paper feed cassette 20 is fed by paper feed transportation means 21, passes by a plurality of intermediate rolls 22A, 22B, 22C, 22D and a registration roll 23, and is transported to secondary transfer roll 15A serving as the secondary transfer means, so that the color image is collectively transferred onto recording member P. Recording member P on which the color image has been transferred is subjected to fixation treatment by heat roll fixation apparatus 24, sandwiched between paper ejection rolls 25, and placed on a paper ejection tray 26 outside.

On the other hand, after the color image is transferred to recording member P by means of secondary transfer roll 15A, remaining toner on endless belt type intermediate transfer element 70 which has self-stripped recording member P is removed by a cleaning apparatus 16A. Preferably, cleaning apparatus 16A is provided with a cleaning blade which is a main cleaning member and equipped with a cleaning roller brought in contact with remaining toner before removal of remaining toner by the cleaning blade. The cleaning roller is preferably a roller in which a surface of a cored bar is covered with such an elastic body as silicone rubber or urethane foam. A cleaning roller which follows endless belt type intermediate transfer element 70 in a manner in contact therewith suffices, however, a cleaning roller driven at a speed 1.1 to 2.0 times as high as a peripheral speed of endless belt type intermediate transfer element 70 is preferred, because occurrence of filming can be prevented without causing abrasion of a surface of endless belt type intermediate transfer element 70.

During a process for image formation, primary transfer roll 15K is always pressure-contacted with photoconductor 11K. Other primary transfer rolls 15Y, 15M, 15C are pressure-contacted with respective corresponding photoconductors 11Y, 11M, 11C only during color image formation.

Secondary transfer roll 15A pressure-contacts with endless belt type intermediate transfer element 70 only when recording member P passes thereby and secondary transfer is carried out.

Thus, toner images are formed on photoconductors 11Y, 11M, 11C, 11K through charging, exposure, and development, and toner images of respective colors are layered on endless belt type intermediate transfer element 70, collectively transferred onto recording member P, and securely fixed through pressurization and heating in fixation apparatus 24. After toner which was left on the photoconductors at the time of transfer is cleaned in cleaning apparatuses 16Y, 16M, 16C, 16K, photoconductors 11Y, 11M, 11C, 11K after the toner images have moved onto recording member P enter a cycle of charging, exposure, and development above, where next image formation is carried out.

A full-color image formation method with the use of a non-magnetic one-component developer can be realized, for example, by using an image formation apparatus in which development means 14Y, 14M, 14C, 14K for two-component developer described previously are replaced with known development means for a non-magnetic one-component developer.

Recording member P used during image formation is not particularly limited, so long as a toner image can be formed thereon with an image formation method of an electrophotography type. Known recording members are exemplified as specific recording members P, and for example, plain paper from thin paper to cardboard, bond paper, art paper, or coated printing paper such as coated paper, commercially available Japan paper or postcard paper, a plastic film for OHP, fabric, and the like are exemplified.

In addition, a fixation method which can be performed in the image formation method with the use of the toner for developing an electrostatic latent image according to the present invention is not particularly limited, and a known fixation technique is available. A roller fixation technique using a heating roller and a pressurization roller, a fixation technique using a heating roller and a pressurization belt, a fixation technique using a heating belt and a pressurization roller, a belt fixation technique using a heating belt and a pressurization belt, and the like are available as known fixation techniques, and any technique may be adopted. Moreover, any known heating technique such as a technique with the use of a halogen lamp and an IH fixation technique can be adopted as the heating technique.

EXAMPLES

Though the present invention will be described below in further detail with reference to Examples, the present invention is not limited thereto. It is noted that "part(s)" in Examples refer(s) to "part(s) by mass" unless otherwise specified.

Example 1

In Example 1, the dry developer in the first embodiment, that is, the dry developer composed of the toner particles having the core-shell structure and the resin-coated carrier, was fabricated.

<Preparation of Additive Particles 1>

Silica particles were fabricated as additive particles 1 through a procedure below, with a sol-gel method. In a reaction vessel provided with a stirrer, a dropping funnel, and a thermometer, 625 parts by mass of methanol, 40 parts by mass of water, and 50 parts by mass of 28 mass % ammonia water were introduced, to thereby fabricate a methanol-water solvent mixture containing ammonia water. A temperature of the solvent mixture was adjusted to 35° C., and 800 parts by mass of tetramethoxysilane, and 420 parts by mass of 5.4 mass % ammonia water were each dropped in the solvent mixture above while stirring. Drop of these compounds was started simultaneously. Tetramethoxysilane was dropped for 3.5 hours and 5.4 mass % ammonia water was dropped for 5 hours.

Even after drop of tetramethoxysilane ended, stirring was continued for 0.5 hour to thereby cause hydrolysis reaction to proceed at a temperature of 30° C. Thereafter, by performing a centrifugation process operation, a silica fine particle dispersion solution in which silica fine particles had been dispersed in the methanol-water solvent mixture was fabricated.

Then, after 3 moles of hexamethyldisilazane were added to 1 mole of silica fine particles ($SiO_2$) in the silica fine particle dispersion solution above, heating to 60° C. and reaction treatment for 3 hours were carried out, so that hydrophobization of the silica fine particles was carried out. After 3 hours of reaction treatment, the methanol-water solvent mixture was distilled out of the dispersion solution under a reduced pressure, so that hydrophobic silica particles (additive particles 1) having a number average primary particles size of 50 nm were obtained.

<Preparation of Additive Particles 2>

Then, commercially available metal oxide particles (a number average primary particle size of 7 nm, a BET value of 300, silica particles subjected to hydrophobization treatment with hexamethyldisilazane) were prepared as additive particles 2 to be added to toner base particles together with the additive particles above.

<Fabrication of Toner Base Particles>

(Fabrication of Resin Particles for Cores A)

(1) First-Step Polymerization

In a reaction vessel to which a stirrer, a temperature sensor, a temperature controller, a cooling pipe, and a nitrogen introduction apparatus were attached, 2 parts by mass of sodium lauryl sulfate which was an anionic surfactant and 2900 parts by mass of ion exchanged water were introduced, to thereby fabricate a surfactant aqueous solution. A temperature was raised to 80° C. while the surfactant aqueous solution was stirred at a stirring speed of 230 rpm under a nitrogen current.

After temperature increase, an initiator solution in which 9 parts by mass of potassium persulfate (KPS) had been dissolved in 200 parts by mass of ion exchanged water was added, a liquid temperature of the surfactant aqueous solution above was set to 78° C., and a monomer liquid mixture containing compounds below was dropped for 3 hours. Namely, after 540 parts by mass of styrene, 270 parts by mass of n-butyl acrylate, and 65 parts by mass of methacrylic acid were dropped, heating and stirring for 1 hour at 78° C. were performed to cause polymerization reaction (first-step polymerization), so that a dispersion solution of "resin fine particles A1" was fabricated.

(2) Second-Step Polymerization

Then, in a reaction vessel to which a stirrer, a temperature sensor, a temperature controller, a cooling pipe, and a nitrogen introduction apparatus were attached, 1100 parts by mass of ion exchanged water and 2 parts by mass of sodium lauryl sulfate were introduced, to thereby fabricate a surfactant aqueous solution, and a temperature was raised to 90° C. After temperature increase, 28 parts by mass in solid content equivalent of "resin fine particles A1" fabricated above and a monomer liquid mixture below were added to the surfactant aqueous solution above. A mechanical dispersion machine having a circulation path (trade name: "Clearmix", manufactured by M Technique Co., Ltd.) was used to perform mixing and dispersion treatment for 4 hours, to thereby prepare a dispersion solution containing emulsified particles having a volume average particle size of 350 nm.

The monomer liquid mixture contained compounds below. Namely, the monomer liquid mixture consisted of 94 parts by mass of styrene, 60 parts by mass of n-butyl acrylate, 11 parts by mass of methacrylic acid, 5 parts by mass of n-octyl mercaptan, and 51 parts by mass of pentaerythritol tetrabehenate.

Pentaerythritol tetrabehenate which was a wax having an ester bond which served as a release agent was added after the monomer above and n-octyl mercaptan which was a chain transfer agent were dissolved, and dissolved through temperature increase to 85° C. An initiator solution in which 2.5 parts by mass of potassium persulfate (KPS) had been dissolved in 110 parts by mass of ion exchanged water was added to the emulsified particle dispersion solution above, and this system was heated and stirred for 2 hours at 90° C. to cause polymerization reaction (second-step polymerization), thus fabricating a dispersion solution of "resin fine particles A2."

(3) Third-Step Polymerization

Then, an initiator solution in which 2.5 parts by mass of potassium persulfate (KPS) had been dissolved in 110 parts by mass of ion exchanged water was added to the dispersion solution of "resin fine particles A2" above, a liquid temperature was set to 80° C., and a monomer liquid mixture containing compounds below was dropped for 1 hour. Namely, after a monomer liquid mixture composed of 230 parts by mass of styrene, 100 parts by mass of n-butyl acrylate, and 13 parts by mass of n-octyl mercaptan was dropped, heating and stirring for 3 hours at a temperature of 80° C. were carried out to thereby cause polymerization reaction (third-step polymerization). Thereafter, cooling to 28° C. was carried out to thereby fabricate a dispersion solution of "resin particles for cores A."

"Resin particles for cores A" fabricated in the procedure above was a styrene acrylic copolymer formed by setting a mass ratio of n-butyl acrylate which was a polymeric monomer having an ester bond to 31 mass %, and had a glass transition temperature of 43° C.

(Fabrication of Resin Particles for Shells B)

A dispersion solution of resin particles for shells containing a styrene acrylic modified polyester resin in which a styrene acrylic copolymer molecular chain had molecularly been bonded to a terminal of a polyester molecular chain was fabricated through a procedure below. Namely, in a reaction vessel to which a nitrogen introduction apparatus, a dewatering pipe, a stirrer, and a thermocouple were attached, 500 parts by mass of a 2-mole adduct of propylene oxide to bisphenol A, 154 parts by mass of terephthalic acid, 45 parts by mass of fumaric acid, and 2 parts by mass of tin octylate were introduced, and polycondensation reaction for 8 hours at a temperature of 230° C. was carried out. After polycondensation reaction was further continued for 1 hour at 8 kPa, cooling to 160° C. was carried out. Polyester molecules were thus formed.

Then, 10 parts by mass of acrylic acid were introduced and mixed in a state of a temperature of 160° C. and held for 15 minutes. Thereafter, a mixture of compounds below was dropped for 1 hour through a dropping funnel. Namely, after 142 parts by mass of styrene, 35 parts by mass of n-butyl acrylate, and 10 parts by mass of a polymerization initiator (di-t-butyl peroxide)

were dropped, addition polymerization reaction was carried out for 1 hour while a temperature of 160° C. was maintained, and thereafter a temperature was raised to 200° C. and held for 1 hour at 10 kPa. Thus, a "styrene acrylic modified polyester resin B1" in which a content of styrene acrylic copolymer molecular chain had been 20 mass % was fabricated.

Then, 100 parts by mass of "styrene acrylic modified polyester resin B1" described previously were subjected to crushing treatment with a commercially available crushing treatment apparatus (trade name: "Roundel Mill", model: RM, manufactured by Tokuju Co., Ltd." In succession, the resultant product was mixed with 638 parts by mass of a sodium lauryl sulfate solution fabricated in advance (a concentration of 0.26 mass %) and subjected to ultrasonic dispersion treatment for 30 minutes at V-LEVEL and 300 μA with the use of an ultrasonic homogenizer (trade name: "US-150T, manufactured by Nippon Seiki Co., Ltd.) while stirring treatment was performed. Thus, a dispersion solution of "resin particles for shells B" having a volume average particle size of 250 nm was fabricated.

(Preparation of Dispersion Solution of Pigment Particles C)

While a solution in which 90 parts by mass of sodium dodecyl sulfate had been dissolved in 1600 parts by mass of ion exchanged water was stirred, 200 parts by mass of the first pigment: carbon black (trade name: "Mogul L", manufactured by Cabot Corporation), 120 parts by mass of the second pigment: C. I. Pigment Brown 25 (trade name: "PV Fast Brown HFR," manufactured by Clariant Japan K. K.), 20 parts by mass of the third pigment: C. I. Pigment Blue 15:3 (a phthalocyanine blue pigment) (trade name: "Fastogen Blue GNPT," manufactured by DIC Corporation), and 60 parts by mass of C. I. Pigment Yellow 180 as the fourth pigment (trade name: "Toner Yellow HG, manufactured by Clariant Japan K. K.) were gradually added. Then, by performing dispersion treatment with the use of a stirrer (trade name: "Clearmix, manufactured by M Technique Co., Ltd.), a dispersion solution of pigment particles C was prepared.

(Fabrication of Toner Base Particles)

In a reaction vessel to which a stirrer, a temperature sensor, a cooling pipe, and a nitrogen introduction apparatus were attached, 308 parts by mass (in solid content equivalent) of the dispersion solution of resin particles for cores A, 1500 parts by mass of ion exchanged water, and 60 parts by mass (in solid content equivalent) of the dispersion solution of pigment particles C were introduced. In addition, a dispersion stabilizer solution in which 3 parts by mass of polyoxyethylene-2-dodecyl ether sodium sulfate had been dissolved in 120 parts by mass of ion exchanged water was added and a liquid temperature was set to 30° C. Thereafter, 5 moles/liter of a sodium hydroxide aqueous solution was added to adjust pH to 10.

Then, a flocculating agent aqueous solution in which 35 parts by mass of magnesium chloride•hexahydrate had been dissolved in 35 parts by mass of ion exchanged water was added for 10 minutes at 30° C. in a stirred state and held for 3 minutes after addition. Then, temperature increase was started. Temperature was increased up to 90° C. for 60 minutes, and the particles above were aggregated and fused while they are held at 90° C.

In this state, a particle size distribution analyzer (trade name: "Multisizer 3", manufactured by Beckman Coulter) was used to measure a particle size of the aggregated particles grown in the reaction vessel. When a volume average particle size attained to 5.2 μm, 32 parts by mass (in solid content equivalent) of the dispersion solution of resin particles for shells B were added, and heating and stirring were continued until resin particles for shells B adhered to the surfaces of the aggregated particles. Then, a small amount of reaction solution was taken out and centrifuged. At the time point when a supernatant was transparent, an aqueous solution in which 150 parts by mass of sodium chloride had been dissolved in 600 parts by mass of ion exchanged water was added to stop growth of the particles. In addition, as aging treatment, a liquid temperature was set to 90° C. and heating and stirring were carried out, so that fusion of the particles proceeded. In this state, fusion of the particles was caused to proceed until average circularity attained to 0.965 in measurement with a particle size distribution analyzer (trade name: "FPIA-2100", manufactured by Sysmex Corporation).

Thereafter, a liquid temperature was lowered to 30° C., hydrochloric acid was used to adjust pH of the liquid to 2, and then stiffing was stopped. Thus, a dispersion solution of the toner base particles was fabricated. The dispersion solution of the toner base particles fabricated through the steps above was subjected to solid-liquid separation in a basket type centrifuge (trade name: "MARK III", model number: 60×40, manufactured by Matsumoto Machine Sales Co., Ltd.), and a wet cake of the toner base particles was formed. This wet cake was subjected to cleaning treatment with ion exchanged water at 45° C. in the basket type centrifuge, until electrical conductivity of a filtrate attained to 5 μS/cm. Thereafter, the wet cake was transferred to a dryer (trade name: "Flash Jet Dryer," manufactured by Seishin Enterprise Co., Ltd.), and drying treatment was performed until an amount of moisture attained to 0.5 mass %, to thereby fabricate the toner base particles having a volume average particle size of 5.5 μm. The volume average particle size was measured with a particle size distribution analyzer (trade name: "FPIA-2100", manufactured by Sysmex Corporation).

As described above, the toner base particles were fabricated by adding 308 parts by mass in solid content equivalent of the dispersion solution of resin particles for cores A, 60 parts by mass in solid content equivalent of the dispersion solution of pigment particles C, and 32 parts by mass in solid content equivalent of the dispersion solution of resin particles for shells B, and therefore a total content of pigments in the toner particles (the toner base particles) was 15 mass %.

<Fabrication of Additive-Treated Toner Particles>

To 100 parts by mass of the toner base particles fabricated above, 1.0 part by mass of additive particles 1 prepared above and 1.5 part by mass of additive particles 2 were added, to perform additive treatment, with a peripheral speed of a stirring vane of a Henschel mixer (trade name: "FM10B", manufactured by Mitsui Miike Chemical Engineering Machinery Co., Ltd.), a treatment temperature, and a treatment time period being set to 40 m/second, 30° C., and 20 minutes, respectively. After additive treatment was performed, a sieve of 90-μm mesh was used to remove coarse particles, to thereby fabricate additive-treated toner particles.

<Fabrication of Resin-Coated Carrier>

The resin-coated carrier was fabricated through a procedure below.

(1) Preparation of Ferrite Core Material Particles

Ferrite particles (a commercially available product) having a volume average particle size of 35 μm were prepared as magnetic core material particles for the resin-coated carrier. These ferrite particles had a manganese content of 21.0 mol % in MnO equivalent, a magnesium content of 3.3 mol % in MgO equivalent, a strontium content of 0.7 mol % in SrO equivalent, and an iron content of 75.0 mol % in $Fe_2O_3$ equivalent. It is noted that a volume average particle size was measured with a commercially available laser diffraction type particle size distribution analyzer (trade name: "HELOS", manufactured by Sympatec GmbH) provided with a wet disperser.

(2) Fabrication of Resin Particles for Coating

In a reaction vessel to which a stirrer, a temperature sensor, a cooling pipe, and a nitrogen introduction apparatus were attached, a surfactant aqueous solution in which 1.7 part by mass of sodium dodecyl sulfate had been dissolved in 3000 parts by mass of ion exchanged water was prepared. While this surfactant aqueous solution was stirred at a stiffing speed of 230 rpm under a nitrogen current, an inside temperature was raised to 80° C. An initiator solution in which 10 parts by mass of potassium persulfate (KPS) had been dissolved in 400 parts by mass of ion exchanged water was added to this surfactant aqueous solution, a liquid temperature was set to 80° C., and a monomer liquid mixture composed of compounds below was dropped for 2 hours. Namely, a monomer liquid mixture composed of 400 parts by mass of cyclohexyl methacrylate, and 400 parts by mass of methyl methacrylate was dropped, and thereafter heating and stirring treatment was performed for 2 hours at a temperature of 80° C. and polymerization reaction was carried out. Thus, a dispersion solution of the resin particles for coating was fabricated. The dispersion solution above was subjected to drying treatment with a spray dryer to thereby fabricate the resin particles for coating.

(3) Fabrication of Resin-Coated Carrier

In the carrier manufacturing apparatus shown in FIG. 1, 3000 parts by mass of ferrite particles having a volume average particle size of 35 μm described above and 120 parts by mass of the resin particles for coating fabricated above were introduced, a peripheral speed of a horizontal rotary blade was set to 4 m/second, and mixing and stirring were carried out for 15 minutes at a temperature of 22° C. After mixing and stirring were carried out, stirring treatment was performed for 40 minutes in a state heated to 120° C., to thereby fabricate the resin-coated carrier having a volume average particle size of 35 μm.

Preparation of Dry Developer

A developer in Example 1 was prepared by using the additive-treated toner particles and the resin-coated carrier fabricated above such that a concentration of the toner particles contained in the developer was 7.0 mass %.

Examples 2 to 18, Comparative Examples 1 to 3

Developers were fabricated as in Example 1, except that pigments shown in Table 1 below were used as the first pigment, the second pigment, the third pigment, and the fourth pigment (some of which may contain other pigments) and an amount of addition (a ratio of addition) of each pigment was set as shown in Table 1. In any Example and Comparative Example, a total content of pigments in the toner particles was 15 mass %, as in Example 1.

TABLE 1

| | First Pigment | Second Pigment | Third Pigment | Fourth Pigment | Other Pigments |
|---|---|---|---|---|---|
| Example 1 | CB1(50) | BR1(30) | C1(5) | Y1(15) | — |
| Example 2 | CB1(52) | BR2(40) | C1(8) | — | — |
| Example 3 | CB2(60) | BR1(40) | — | — | — |
| Example 4 | CB2(40) | BR1(45) | C2(10) | Y1(5) | — |
| Example 5 | CB2(60) | BR1(25) | C1(4) | Y1(11) | — |
| Example 6 | CB1(40) | BR1(42) | C1(10) | Y2(8) | — |
| Example 7 | CB1(60) | BR1(28) | C1(2) | Y3(10) | — |

TABLE 1-continued

| | First Pigment | Second Pigment | Third Pigment | Fourth Pigment | Other Pigments |
|---|---|---|---|---|---|
| Example 8 | CB2(38) | BR2(45) | C1(11) | Y1(6) | — |
| Example 9 | CB1(61) | BR1(30) | C1(5) | Y4(4) | — |
| Example 10 | CB2(60) | BR1(23) | C1(8) | Y1(9) | — |
| Example 11 | CB1(42) | BR1(47) | C2(10) | Y1(2) | — |
| Example 12 | CB1(55) | BR1(32) | C1(1) | Y2(12) | — |
| Example 13 | CB1(40) | BR2(45) | C1(12) | Y2(3) | — |
| Example 14 | CB2(39) | BR1(55) | — | Y1(6) | — |
| Example 15 | CB1(61) | BR1(20) | C1(14) | Y1(5) | — |
| Example 16 | CB2(38) | BR1(61) | C1(1) | — | — |
| Example 17 | CB1(62) | BR1(22) | C1(16) | — | — |
| Example 18 | CB(52) | BR1(26) | C1(7) | Y1(10) | M1(5) |
| Comparative Example 1 | CB1(100) | — | — | — | — |
| Comparative Example 2 | CB1(55) | — | C1(45) | — | — |
| Comparative Example 3 | CB1(55) | — | — | Y1(45) | — |

A numeric value for each pigment in parentheses represents a content (mass %) with respect to a total amount of pigments.

Various signs in Table 1 mean the following.

CB1: Carbon black (trade name: "Mogul L", manufactured by Cabot Corporation)

CB2: Carbon black (trade name: "MA77", manufactured by Mitsubishi Chemical Corporation)

BR1: C.I. Pigment Brown 25 (trade name: "PV Fast Brown HFR," manufactured by Clariant Japan K. K.)

BR2: C.I. Pigment Brown 23 (trade name: "Cromophtal Brown 5R," manufactured by BASF)

C1: C.I. Pigment Blue 15:3 (trade name: "Fastogen Blue GNPT," manufactured by DIC Corporation)

C2: C.I. Pigment Blue 15:4 (trade name: "Fastogen Blue GNPS-G," manufactured by DIC Corporation)

Y1: C.I. Pigment Yellow 180 (trade name: "Toner Yellow HG," manufactured by Clariant Japan K. K.)

Y2: C.I. Pigment Yellow 185 (trade name: "PALIOTOL YELLOW D 1155," manufactured by BASF)

Y3: C.I. Pigment Yellow 74 (trade name: "Seikafast Yellow 2054," manufactured by Dainichiseica Color & Chemicals Mfg. Co., Ltd.)

Y4: C.I. Pigment Yellow 155 (trade name: "Toner Yellow 3GP," manufactured by Clariant Japan K. K.)

M1: C.I. Pigment Red 122 (trade name: "FASTOGEN Super Magenta RTS," manufactured by DIC Corporation)

It is noted that an empty field ("—") in Table 1 indicates that no corresponding substance is contained.

[Measurement of Volume Average Particle Size]

A volume average particle size of the toner base particles in each Example and each Comparative Example was measured with a particle size distribution analyzer (trade name: "FPIA-2100", manufactured by Sysmex Corporation). Table 2 shows measurement results.

[Evaluation 1]

Figure 3:
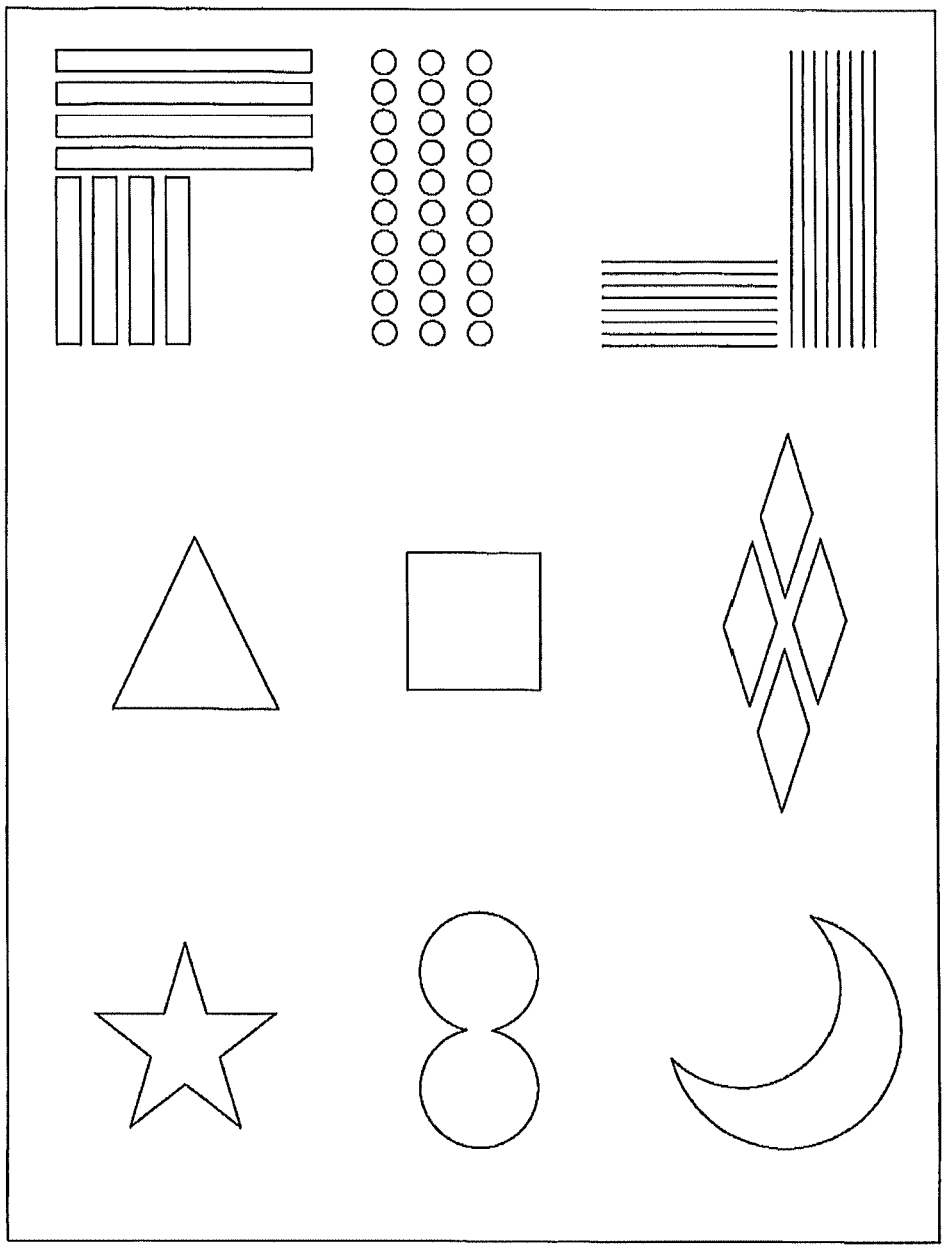
FIG. 3 is a diagram showing an image used for evaluation of Examples.

A commercially available multi function peripheral corresponding to the image formation apparatus shown in FIG. 2 (trade name: bizhub PRO C6500, manufactured by Konica Minolta Business Technologies, Inc.) was used, each developer in Examples and Comparative Examples was used as black toner in an environment where a temperature was 25° C. and a relative humidity was 55% RH, and images were created by making 2000 continuous prints for each developer without using toner of other colors. An image created in continuous prints was such that an image of a photography of a person's face, a halftone image having relative reflection density of 0.4, a white background image, and a solid image having relative reflection density of 1.3 were output in quarters on a recording material (coated paper) of A4 size. It is noted that relative reflection density of the halftone image and the solid image was represented as a measurement value with the use of a Macbeth densitometer (trade name: "RD918", manufactured by Sakata Inx Eng. Co., Ltd.). Then, at the end of making of 2000 continuous prints, an image shown in FIG. 3 was continuously printed on 10 sheets such that an amount of adhesion on the recording material (coated paper) was 4.0 g/m$^2$, which were in turn used for evaluation below.

<Image Density Evaluation>

Image density of a solid pattern of 10 prints obtained above was measured with a densitometer (trade name: "X-Rite model 404], manufactured by X-Rite, Incorporated.) and evaluation in three ranks below was made.

A: Image density being 1.8 or higher

B: Image density being 1.7 or higher and lower than 1.8

C: Image density being lower than 1.7

Table 2 shows results.

<Transfer Performance Evaluation 1>

A Macbeth densitometer (trade name: "RD918", manufactured by Sakata Inx Eng. Co., Ltd.) was used to measure density at 20 locations on the recording material (coated paper) on which no print was created, and an average thereof was defined as white paper density. Then, density of a white background image on 10 prints obtained above was measured at 20 locations, and a value calculated by subtracting white paper density measured above from average density thereof was defined as fog density. Evaluation in three ranks below was made.

A: Fog density being lower than 0.005

B: Fog density being 0.005 or higher and lower than 0.01

C: Fog density being 0.01 or higher

Lower fog density indicates excellent transfer performance (that is, the problem of dissatisfactory transfer was lessened). Table 2 shows results.

<Evaluation of Hue>

A hue of a solid pattern of 10 prints obtained above was evaluated with the use of a spectrophotometer (trade name; "CM-3700d", manufactured by Konica Minolta, Inc.). Specifically, a color difference ΔE between this single-color solid pattern and Japan Color 2007 chart (type of paper: coated paper, manner: black single-color solid portion) was calculated, an average value thereof was calculated, and evaluation in three ranks below was made. Color difference ΔE was defined as a square root of the sum of squares of differences on the L* axis, the a* axis, and the b* axis in the uniform color space of the L*a*b* colorimetric system defined under JIS Z 8729.

A: Color difference ΔE being smaller than 3

B: Color difference ΔE being 3 or greater and smaller than 6

C: Color difference ΔE being 6 or greater

Smaller color difference ΔE indicates an excellent hue. Table 2 shows results.

[Evaluation 2]

<Fabrication of Yellow Toner>

(Preparation of Dispersion Solution of Pigment Particles Y)

While a solution in which 90 parts by mass of sodium dodecyl sulfate had been dissolved in 1600 parts by mass of ion exchanged water was stirred, 400 parts by mass of C. I. Pigment Yellow 185 (trade name: "PALIOTOL YELLOW D 1155," manufactured by BASF) was gradually added as a yellow pigment. Then, dispersion treatment was performed with the use of a stirrer (trade name: "Clearmix, manufactured by M Technique Co., Ltd.), to thereby prepare a dispersion solution of pigment particles Y. Additive-treated toner particles were fabricated with a method the same as that for black toner, except for use of 296 parts by mass (in solid content equivalent) of the dispersion solution of resin particles for cores A and 72 parts by mass (in solid content equivalent) of the dispersion solution of pigment particles Y instead of the dispersion solution of pigment particles C in fabrication of the toner base particles.

<Image Formation>

A commercially available multi function peripheral corresponding to the image formation apparatus shown in FIG. 2 (trade name: bizhub PRO C6500, manufactured by Konica Minolta Business Technologies, Inc.) was used, the yellow toner fabricated above was used in an environment where a temperature was 25° C. and a relative humidity was 55% RH, and 1000 continuous prints were made. Thereafter, 1000 continuous prints were made by using each developer in Examples and Comparative Examples as black toner, to thereby create an image. An image created in continuous prints was such that an image of a photography of a person's face, a halftone image having relative reflection density of 0.4, a white background image, and a solid image having relative reflection density of 1.3 were output in quarters on a recording material (coated paper) of A4 size. Then, at the time when 2000 continuous prints (1000 yellow prints+1000 black prints) ended, 10 continuous prints were made such that an image shown in FIG. 3 was superimposed with black toner on the solid image output with the yellow toner and an amount of adhesion on the recording material (coated paper) was each 2.5 g/m$^2$, which were in turn used for evaluation below.

<Transfer Performance Evaluation 2>

A Macbeth densitometer (trade name: "RD918", manufactured by Sakata Inx Eng. Co., Ltd.) was used to measure density of a yellow solid image formed only with the yellow toner at 20 locations, and an average value thereof was defined as image density a. Then, density of an image at a site in 10 prints obtained above where no black toner had been placed was measured at 20 locations, and a value calculated by subtracting image density a measured above from an average value thereof (image density b) was defined as fog density. Evaluation in three ranks below was made.

A: Fog density being lower than 0.005

B: Fog density being 0.005 or higher and lower than 0.01

C: Fog density being 0.01 or higher

Lower fog density indicates excellent transfer performance (that is, the problem of dissatisfactory transfer was lessened). Table 2 shows results.

[Process Conditions]

Process conditions and outlines of the process adopted during image formation with the use of the image formation apparatus in each Example and each Comparative Example are as follows.

System Speed: 40 cm/s

Photoconductor: Negatively charged OPC

Charge Potential: −700 V

Development Voltage (Voltage Applied to Development Roller): −450 V

Primary Transfer Voltage (Voltage Applied to Transfer Roller): +600 V

Secondary Transfer Voltage: +1200 V

Pre-Development Corona CHG: Adjusted as appropriate between −3 and 5 kV of needle application voltage

TABLE 2

| | Volume Average Particle Size (μm) | Image Density | Evaluation: Image Density | Transfer Performance 1 | Transfer Performance 2 | Hue |
|---|---|---|---|---|---|---|
| Example 1 | 5.5 | 1.83 | A | A | A | A |
| Example 2 | 5.6 | 2.04 | A | A | B | B |

TABLE 2-continued

| | Volume Average Particle Size (μm) | Image Density | Evaluation | | | |
|---|---|---|---|---|---|---|
| | | | Image Density | Transfer Performance 1 | Transfer Performance 2 | Hue |
| Example 3 | 5.3 | 2.18 | A | A | A | B |
| Example 4 | 5.7 | 1.83 | A | A | A | A |
| Example 5 | 5.5 | 2.00 | A | A | A | A |
| Example 6 | 5.4 | 1.78 | B | A | A | A |
| Example 7 | 5.6 | 2.03 | A | A | A | A |
| Example 8 | 5.3 | 1.78 | B | A | B | B |
| Example 9 | 5.2 | 2.10 | A | B | B | A |
| Example 10 | 5.6 | 1.99 | A | B | B | B |
| Example 11 | 5.2 | 1.91 | A | A | A | B |
| Example 12 | 5.4 | 1.95 | A | A | A | B |
| Example 13 | 5.4 | 1.84 | A | B | B | B |
| Example 14 | 5.8 | 1.87 | A | A | A | B |
| Example 15 | 5.3 | 2.01 | A | B | B | B |
| Example 16 | 5.2 | 1.95 | A | A | A | B |
| Example 17 | 5.5 | 2.08 | A | B | B | B |
| Example 18 | 5.4 | 1.83 | A | A | A | A |
| Comparative Example 1 | 5.4 | 2.60 | A | C | C | A |
| Comparative Example 2 | 5.1 | 1.78 | B | C | C | C |
| Comparative Example 3 | 5.6 | 1.49 | C | A | A | C |

As is clear from Table 2, it could be confirmed that the dry developers in Examples were better in image density and hue than the dry developers in Comparative Examples and exhibited good transfer performance (namely, the problem of dissatisfactory transfer was prevented).

Since the dry developer in Comparative Example 1 contained as the pigment, only carbon black representing the first pigment, transfer performance was poor, although image density and the hue were satisfactory. Comparative Example 2 did not achieve improvement in transfer performance and it was poor in hue, in spite of addition of a cyan pigment other than carbon black. Comparative Example 3 was poor in hue, although transfer performance was improved by addition of a yellow pigment other than carbon black. Based on these comparison experiments, an effect of use together of the first pigment and the second pigment in the present invention was demonstrated.

Though the embodiments and the examples of the present invention have been described above, combination of features in each embodiment and example described above as appropriate is also originally intended.

Although the present invention has been described and illustrated in detail, it is clearly understood that the same is by way of illustration and example only and is not to be taken by way of limitation, the scope of the present invention being interpreted by the terms of the appended claims.

What is claimed is:

1. Toner for developing an electrostatic latent image, comprising toner particles, said toner particles containing a resin and a pigment, said pigment including a first pigment and a second pigment, said first pigment being carbon black, said second pigment being C. I. Pigment Brown 23 and/or C. I. Pigment Brown 25, and said carbon black being contained in said toner particles by 4 mass % or more with respect to a total amount of said toner particles.

2. The toner for developing an electrostatic latent image according to claim 1, wherein said pigment further includes a third pigment and/or a fourth pigment, said third pigment is C. I. Pigment Blue 15:3 and/or C. I. Pigment Blue 15:4, and said fourth pigment is at least one type of a yellow pigment selected from the group consisting of C. I. Pigment Yellow 74, C. I. Pigment Yellow 155, C. I. Pigment Yellow 180, and C. I. Pigment Yellow 185.

3. The toner for developing an electrostatic latent image according to claim 1, wherein said first pigment is contained by 40 to 60 mass % with respect to a total amount of said pigment, and said second pigment is contained by 25 to 45 mass % with respect to the total amount of said pigment.

4. The toner for developing an electrostatic latent image according to claim 2, wherein said first pigment is contained by 40 to 60 mass % with respect to a total amount of said pigment, and said second pigment is contained by 25 to 45 mass % with respect to the total amount of said pigment.

* * * * *